US008272325B2

(12) United States Patent
Goodridge et al.

(10) Patent No.: US 8,272,325 B2
(45) Date of Patent: Sep. 25, 2012

(54) DETONATOR FREE LASER INITIATED BLASTING SYSTEM

(75) Inventors: Richard John Goodridge, Kurri Kurri (AU); Rodney Wayne Appleby, Springfield (AU); David Olaf Johnson, Aurora, CO (US); Thomas Miller, Evergreen, CO (US)

(73) Assignee: Orica Explosives Technology Pty., Ltd., Melborne, Victoria (AU)

( * ) Notice: Subject to any disclaimer, the term of this patent is extended or adjusted under 35 U.S.C. 154(b) by 245 days.

(21) Appl. No.: 12/450,137

(22) PCT Filed: Mar. 14, 2008

(86) PCT No.: PCT/AU2008/000364

§ 371 (c)(1), (2), (4) Date: Mar. 5, 2010

(87) PCT Pub. No.: WO2008/113108

PCT Pub. Date: Sep. 25, 2008

(65) Prior Publication Data

US 2010/0180786 A1 Jul. 22, 2010

Related U.S. Application Data

(60) Provisional application No. 60/895,321, filed on Mar. 16, 2007.

(51) Int. Cl.
*F42B 3/113* (2006.01)

(52) U.S. Cl. ..... 102/201; 102/215

(58) Field of Classification Search ..... 102/201, 102/215

See application file for complete search history.

(56) References Cited

U.S. PATENT DOCUMENTS

| | | | | |
|---|---|---|---|---|
| 3,291,046 | A * | 12/1966 | Dahl | 102/202.9 |
| 3,724,383 | A | 4/1973 | Gallaghan | |
| 4,727,808 | A * | 3/1988 | Wang et al. | 102/202.5 |
| 4,984,518 | A * | 1/1991 | Yarrington | 102/201 |
| 5,101,727 | A * | 4/1992 | Yarrington | 102/201 |
| 5,179,247 | A | 1/1993 | Hawley | |
| 5,385,098 | A * | 1/1995 | Lindqvist et al. | 102/205 |
| 7,568,429 | B2 * | 8/2009 | Hummel et al. | 102/206 |
| 7,883,593 | B1 * | 2/2011 | Rose et al. | 149/37 |
| 8,161,880 | B2 * | 4/2012 | Wuensche et al. | 102/275.11 |
| 2008/0302264 | A1 * | 12/2008 | Hummel et al. | 102/215 |
| 2009/0165664 | A1 * | 7/2009 | Jones et al. | 102/355 |
| 2009/0193993 | A1 * | 8/2009 | Hummel et al. | 102/215 |
| 2010/0225155 | A1 * | 9/2010 | Spathis et al. | 299/13 |

FOREIGN PATENT DOCUMENTS

| | | |
|---|---|---|
| EP | 0 289 184 | 12/1991 |
| EP | 1 443 297 | 8/2004 |

OTHER PUBLICATIONS

International Search Report for PCT/AU2008/000364, mailed May 7, 2008.

International Preliminary Report on Patentability for PCT/AU2008/000364, 8 pages including 4 amended sheets, (Jul. 6, 2009).

* cited by examiner

*Primary Examiner* — Michael David

(74) *Attorney, Agent, or Firm* — Nixon & Vanderhye PC

(57) ABSTRACT

A detonator free blasting system, which comprises: a bulk explosive; a confined explosive; a fiber optic adapted to deliver laser light to the confined explosive, wherein the confined explosive is provided relative to the bulk explosive such that detonation of the confined explosive causes initiation of the bulk explosive.

17 Claims, 4 Drawing Sheets

DETONATOR FREE LASER INITIATED BLASTING SYSTEM

This application is the U.S. national phase of International Application No. PCT/AU2008/000364, filed 14 Mar. 2008, which designated the U.S. and claims the benefit of U.S. Provisional Application No. 60/895,321, filed 16 Mar. 2007, the entire contents of each of which are hereby incorporated by reference.

The present invention relates to a system for initiating (detonating) an explosives charge. More particularly, the present invention provides such a system that does not rely on the use of conventional detonators. The present invention also relates to a method of initiating an explosives charge that does not require the use of conventional detonators.

BACKGROUND TO INVENTION

A detonator (or blasting cap) is a device that has been specifically designed to initiate detonation of a separate, larger charge of secondary explosive. Detonators are commonly used in a broad range of commercial operations in which explosives charges are detonated, including mining and quarrying and seismic exploration. Conventional thinking has been that the use of detonators is essential to implementation of such operations. However, this brings with it considerations as to chain of supply, security and safety.

Against this background it would be desirable to provide a system for initiating an explosives charge that does not rely on the use of detonators. The present invention seeks to provide such a system.

SUMMARY OF INVENTION

In accordance with the present invention it has been found possible to initiate an explosives charge without resorting to the use of conventional detonator devices. More specifically, in accordance with the present invention explosives charges may be initiated using a laser.

Accordingly, in one embodiment the present invention provides a detonator free blasting system, which comprises:

- a bulk explosive;
- a confined explosive;
- a fiber optic adapted to deliver laser light to the confined explosive,
- wherein the confined explosive is provided relative to the bulk explosive such that detonation of the confined explosive causes initiation of the bulk explosive.

In another embodiment the present invention provides a method of initiating a bulk explosive, which method comprises:

- detonating a confined explosive by irradiation with a laser,
- wherein the confined explosive is provided relative to the bulk explosive such that detonation of the confined explosive causes initiation of the bulk explosive.

In accordance with the present invention a bulk explosive (charge) is initiated by detonation of a confined explosive (charge). In turn initiation of the confined explosive is caused by irradiation of the confined explosive with laser light. Thus, the bulk explosive is initiated without using a conventional detonator device. This is believed to represent a significant advance in the art.

In accordance with the present invention laser initiation is achieved by heating the confined explosive until ignition of it occurs. The confined explosive is confined such that this initial ignition propagates to full detonation. The confined explosive and bulk explosive are provided relative to one another such that detonation of the confined explosive causes initiation of the bulk explosive. In an embodiment of the invention a portion of the confined explosive and a portion of the bulk explosive may be in direct contact. However, in other embodiments this may not be essential provided that the intended operative relationship between the confined and bulk explosives is retained. For example, in certain embodiments, the confined and bulk explosives may be separated by a membrane, or the like. In this case the membrane, or the like, may be included for ease of manufacture; the membrane (or like) does not influence detonation of the bulk explosive The confined explosive is usually a secondary explosive material. Examples of suitable materials include PETN (pentaerythritol tetranitrate), tetryl (trinitrophenylmethylnitramine), RDX (trimethylenetrinitramine), HMX (cyclotetramethylene-tetranitramine), pentolite (PETN and TNT (trinitrotoluene)), and the like. Of these the use of PETN or pentolite is preferred. In an alternative embodiment the confined explosive may be a conventional emulsion explosive, such as a water-in-oil emulsion including a discontinuous oxidiser salt phase dispersed in a fuel oil. Typically, such emulsions include ammonium nitrate and/or sodium nitrate as the oxidiser salt. Such emulsion compositions are very well known in the art. Additionally, the confined explosive may be a conventional watergel explosive which contains an oxidizer salt, a sensitizer, a thickener, a crosslinking agent, and a fuel. These compositions are well known in the art as well.

The bulk explosive that is used is generally a secondary explosive too, examples of which are given above. When confined explosive and bulk explosive are secondary explosives it will be appreciated that the blasting system of the invention is free of primary explosives. The bulk explosives charge may be the same as or different from the confined explosive. When the confined explosive is the same as the bulk explosive, the invention may be implemented by suitable confinement of a portion of the bulk explosive.

An important aspect of the present invention is the way in which the confined explosive is confined since it has been found that the geometry of the confinement is critical to the successful detonation of the bulk explosive. Thus, the confined explosive should be confined in such a manner to contain initial ignition of the confined explosive and to allow subsequent propagation to full detonation. A variety of confinement means (geometry and material) may be employed in implementation of the present invention.

In one embodiment the confined explosive may be confined in an elongate tubular member. Usually, this will be of circular cross-section, although this is not mandatory. When an elongate tubular member is used, the internal diameter of the tubular member should be greater than the critical diameter for the explosive being confined. When the confined explosive is strongly confined, for example, when the confinement means is made of a metal, the internal diameter of the tubular member may be up to 3 times larger than the critical diameter for the explosive being confined.

A typical tubular member of circular cross-section useful in the present invention generally has an internal diameter of about 2 to about 5 mm, for example about 3 mm, and a length of up to about 110 mm, for example from 20 to 110 mm. The length of the tubular member required for transition of the confined explosive will vary as between different types of explosive. For example, for PETN the minimum length of the tubular member will be about 30 mm, whereas for pentolite the minimum length will be about 90 mm (for an internal diameter of about 3 mm).

The confinement means may take on other geometries. Thus, spherical or conical confinement means may be used For the purposes of illustration, in the following, the invention will be described in connection with a tubular elongate member of circular cross-section as confinement means.

Examples of suitable materials for the confinement means include metals and metal alloys, for example aluminium and steel, and high strength polymeric materials.

Typically, the bulk explosive is provided in (direct) contact with a portion of the confined explosive. When the confined explosive is confined in an elongate tubular member the requisite contact may be achieved via an end of the tubular member in which the confined portion is confined (that end being remote from the end of the tubular member to which laser light is delivered through the fiber optic). When other geometries of confinement means are employed it is important that at least a portion of the confined explosive is in contact with the bulk explosive.

The blasting system of the present invention includes a fiber optic that is adapted to communicate laser light to the confined explosive. This can be done by providing one end of the (exposed) fiber optic in contact with, or embedded in, the confined explosive. Thus, one end of the fiber optic may be inserted into an end of the tubular member in which the confined explosive is confined. The fiber optic will usually have a diameter of from 50 to 400 μm.

In an embodiment of the present invention the exposed end of the fiber optic may be provided adjacent to but not in contact with the (external surface of the) explosive. It has been found that providing a gap (of air) between the end of the (exposed) fiber optic and the confined explosive has an effect on heat transfer to the confined explosive and thus on the delay time between when laser light is discharged through the fiber optic and when the confined explosive is initiated. More specifically, it is believed that the gap acts as an insulator that facilitates efficient heat transfer to the confined explosive by minimizing/avoiding reverse conduction effects. Preferably, the exposed end of the fiber optic is provided at a short distance away from the surface of the initiation explosive in the tubular member. Typically, this short distance is from 5 μm to 5.0 mm The fiber optic is of conventional design and is provided with a layer of cladding. This may be removed at one end of the fiber optic when the fiber optic is being positioned relative to the confined explosive provided in the tubular member. The characteristics of the fiber optic will be selected based on amongst other things the wavelength of laser light to be communicated to the confined explosive. By way of example the wavelength is typically from 780 to 1450 nm.

The exposed end of the fiber optic is usually held in an appropriate position relative to the confined explosive by means of a suitable connector. An O-ring may be used to grip the exposed end of the fiber optic and to prevent leakage of gas.

Depending upon the characteristics of the system, including but not limited to the heating aspect of the laser and the type of confined explosive used, it may be necessary for implementation of the present invention to include in the confined explosive a non-explosive heat transfer medium in order to enhance coupling of the laser light energy to the confined explosive. Typically, the heat transfer medium is a laser light absorbing material that has an absorption band in the wavelength of the laser light being used. Examples of heat transfer media include carbon black, carbon nanotubes, nanodiamonds and laser dyes. Such materials are commercially available. Generally, when used, the confined explosive will include up to 10% by weight of heat transfer medium. The amount of heat transfer medium to be used may be optimised by experimentation.

In the same way, other additives that serve as a thermal source and that actively take part in detonation reactions may be included in the confined explosive. Such materials include nanothermites, nanometals, nitrated nanomaterials and other optically sensitive fuels. The amount of such materials may be up to 10% by weight of the confined portion. Such materials may be used together with a heat transfer medium, or alone. The use of one or more heat transfer media and/or optically sensitive materials may allow detonation to be achieved with laser energies orders of magnitude lower than when such media and/or materials are not used The explosives charge that it is desired to detonate is generally provided in (direct) contact with at least a portion of the confined explosive. Typically, this contact will occur at the end of the tubular member in which the confined explosive is confined remote from the end of the tubular member associated with the fiber optic. Depending upon the form in which the explosive charge is provided, the explosives charge may also surround the tubular member in which the confined explosive is confined. In other words the tubular member may be embedded in the explosives charge.

In one embodiment of the invention the explosive charge takes the form of a booster, for example a pentolite booster. In this case the confined explosive, preferably PETN or pentolite, is provided in an elongate tubular member that is embedded in the booster. The booster may be designed accordingly to accommodate the tubular member. Thus, the tubular member may be provided and secured in the booster in a suitable well, as is the case for detonator initiated boosters. Otherwise, conventional boosters may be used to implement this embodiment.

Alternatively, in another embodiment of the invention, the pentolite booster may be cast around and with a suitable tubular member. In this case it may be possible to implement the invention using a one-piece booster comprising a shell/casing and an integrally formed tubular member extending into a cavity defined by the shell/casing. Suitable explosives material(s) may then be cast into the shell/casing and tubular member.

These embodiments of the present invention relating to the booster may have practical application in seismic exploration where (pentolite) boosters are used to generate signals (shock waves) for analysis to determine geological characteristics in the search for oil and gas deposits. The present invention thus extends to use of this embodiment of the invention in seismic exploration.

In another embodiment of the present invention the explosive charge takes the form of a length of detonating cord. In this case the end of the detonating cord is provided in direct contact with at least a portion of a confined explosive. Any suitable retainer or connector may be used to ensure that this direct contact is maintained prior to use. Initiation of the detonating cord aside, the detonating cord may be used in conventional manner. Instantaneous detonation of detonating cord across multiple blastholes could prove advantageous in pre-split and tunnel perimeter blasting applications.

In another embodiment the confined and bulk explosives may be an emulsion explosive material. Conventional emulsion explosive material may be used in this regard. In this embodiment a portion of the emulsion explosives material may be confined in a suitable elongate tubular member and immersed/embedded in bulk emulsion explosives material. In this embodiment (and for all others) the nature and dimensions of the means used for confinement may be manipulated in order to optimise implementation of the invention.

The laser light required to initiate the confined explosive in accordance with the present invention may emanate from a variety of laser sources, such as solid lasers and gas laser may be used. A laser beam may also be generated by a laser diode. Typically, the characteristics of the laser beam useful in accordance with the present invention are emanating from a diode laser with a wavelength within the near-infrared region. In practice, the laser would usually be a self-contained diode laser and power source. The laser may be coupled in conventional manner to a fiber optic. Useful lasers, power sources and fiber optics are commercially available.

In accordance with embodiments of the present invention the use of additives and suitable stand-off between the end of the fiber optic and the confined explosive may enable initiation of explosives using laser powers of relatively low magnitude (less than 1 W). Combined with the use of diode lasers this now facilitates successful implementation of the present invention using small hand-held laser systems.

BRIEF DESCRIPTION OF FIGURES

Embodiments of the present invention are illustrated in the accompanying non-limiting figures in which:

FIG. 1*a* illustrates an initiating system 1 comprising an explosive 2 confined in a elongate tubular member 3 made of steel. The dimensions of the tube are 3.2 mm internal diameter, 6.4 mm outer diameter, 110 mm length. The confined explosive is PETN and is compacted into the tubular member 3 at a loading density of approximately 1.0 g/cm$^3$. When pentolite is used it may be cast into the tube. The density of cast pentolite is 1.6 g/cm$^3$. Both the PETN and pentolite may be doped with heat transfer medium and/or optically sensitive material. Typically, in the embodiments illustrated in the figures PETN and pentolite doped with 2% carbon black has been found to be useful for implementation of the present invention.

Figure 1A:
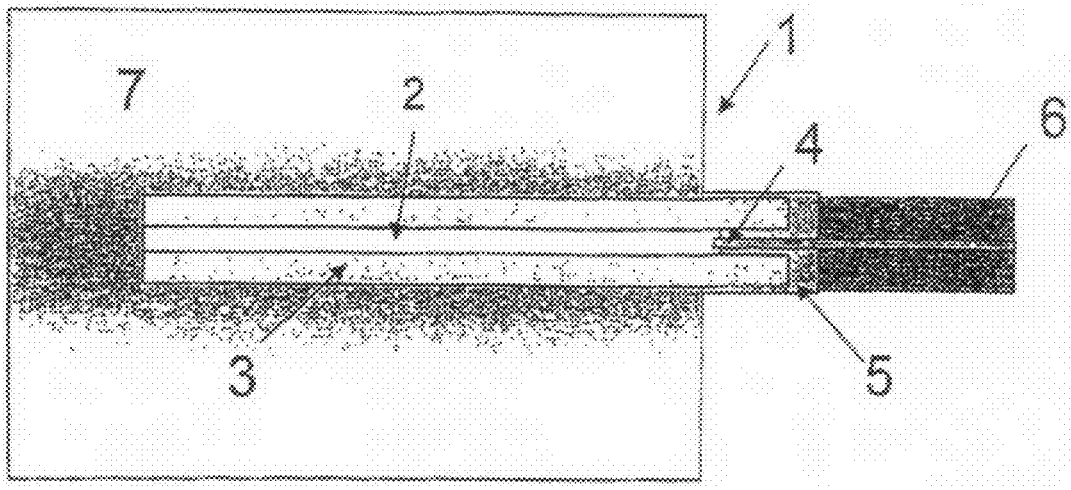
FIGS. 1*a*, 1*b*, 2, 3 and 4 are schematics illustrating blasting systems in accordance with the present invention.

One end of the tubular member 3 is connected to a fiber optic 4 using a fiber optic connector 5. The fiber optic 4 includes an outer layer of cladding 6. The exposed end of the fiber optic 4 extends into the tubular member 3 and is in contact with the confined explosive 2. The tubular member 3 is inserted into a booster 7 via a well that is provided in the booster 7. An O-ring is used to grip the exposed end of the fiber optic 4.

In use a laser source (not shown) is used to deliver laser light through the fiber optic 4 to the confined explosive 2. This causes heating of the confined explosive 2 leading to ignition. If the confined explosive 2 is suitably confined, the initial ignition propagates to full detonation. In turn this causes detonation of the booster 7.

Figure 1B:
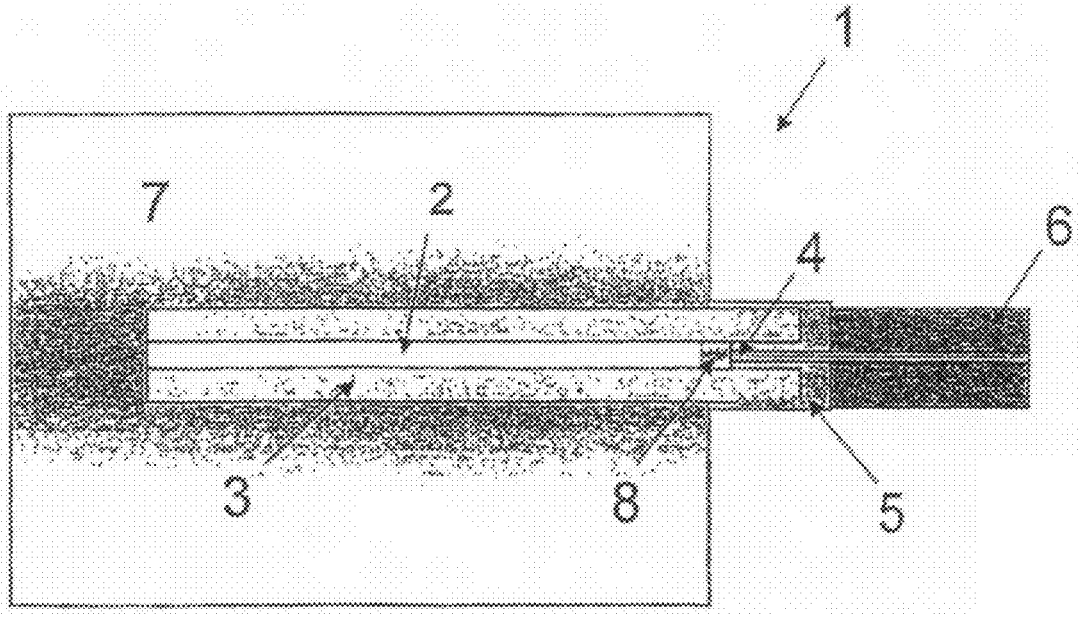

FIG. 1*b* shows a similar arrangement although in this case a gap 8 is provided between the end of the fiber optic 4 and the confined explosive 2. The effect of this gap 8 is to retard heat transfer from the exposed end of the fiber optic 4 to the confined explosive 2, thereby influencing the delay time between when the laser is discharged and the initiation explosive initiated.

Figure 2:
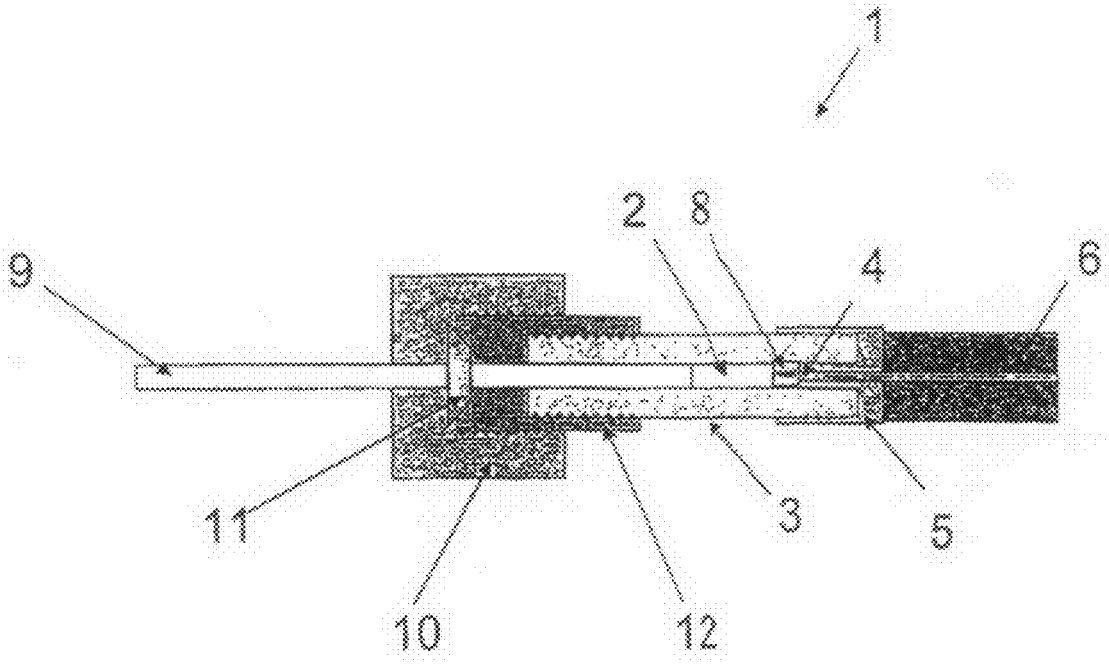

FIG. 2 illustrates an initiating system 1 similar to that shown in FIG. 1*b* except that in FIG. 2 an open end of a length of detonating cord 9 is provided in contact with the confined explosive 2 in the tubular member 3. A retaining nut 10 and ferrule 11 and compression fitting 12 are used to hold the detonating cord 9 in place relative to the confined explosive 2. As in FIG. 1*b* a gap 8 is provided between the exposed end of the fiber optic 4 and the confined explosive 2.

A laser source (not shown) is used to generate a beam of laser light that is communicated to the confined portion 2 via the fiber optic 4. This causes heating and ignition of the confined portion 2. Detonation of the confined portion 2 in turn causes initiation of the detonating cord 9.

Figure 3:
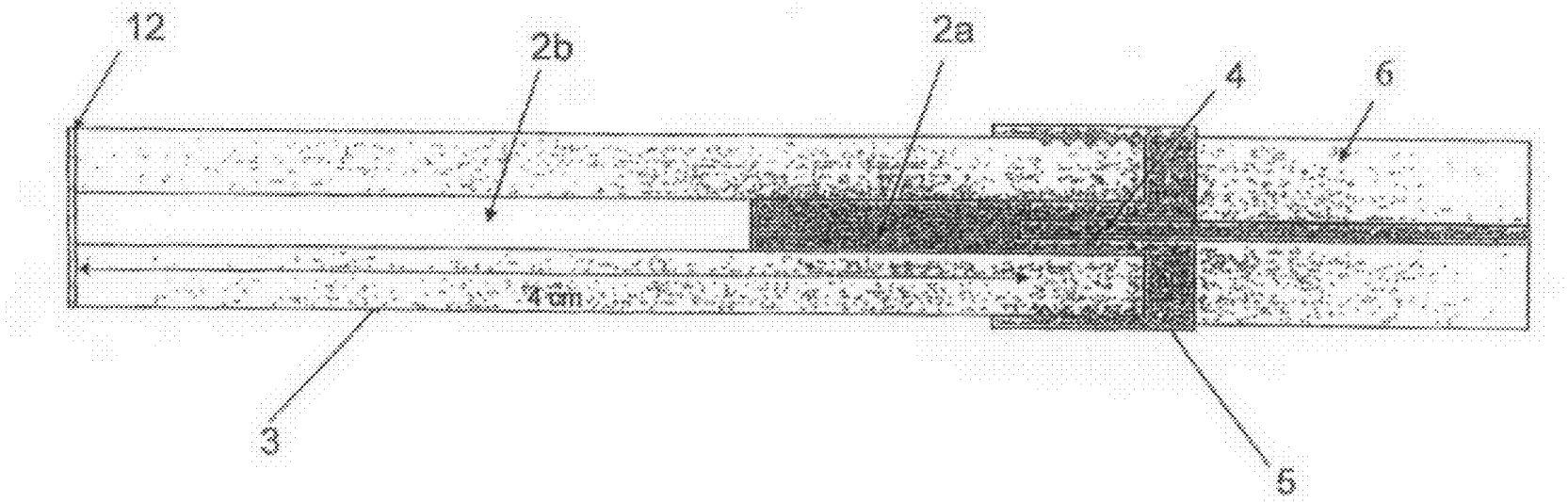
Figure 4:
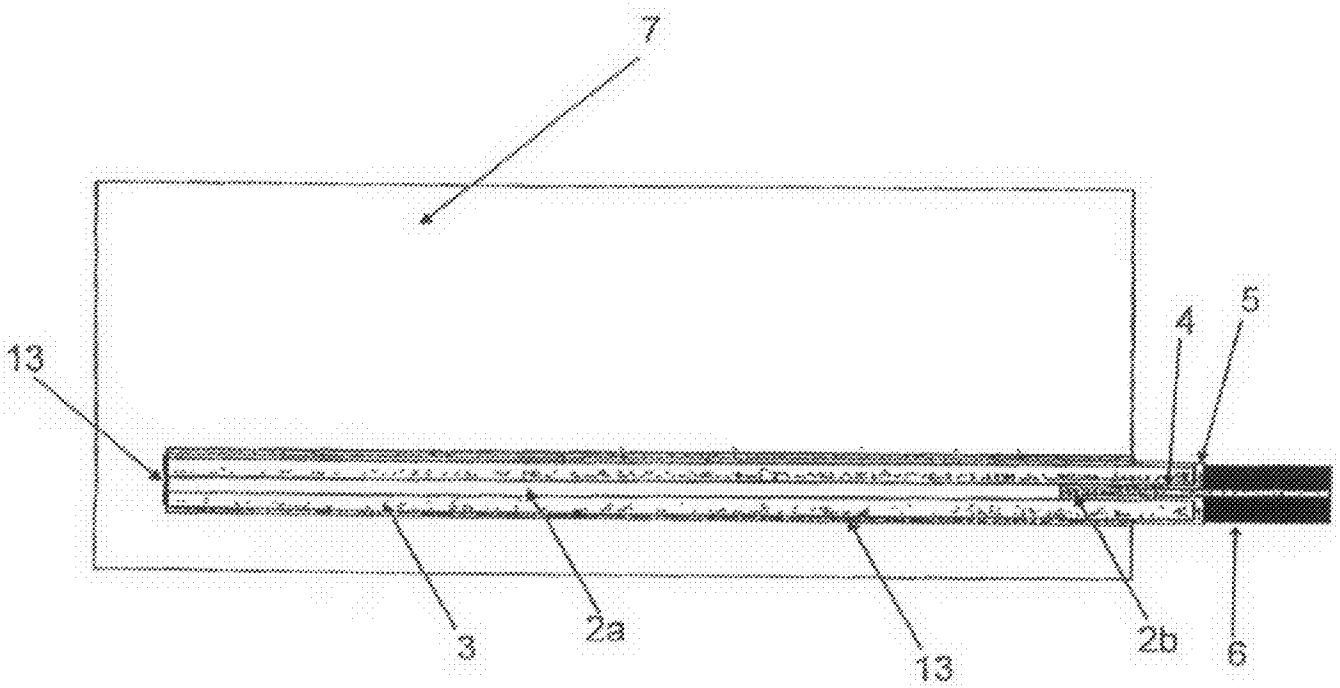

FIGS. 3 and 4 are discussed below in the examples.

The following non-limiting examples illustrate embodiments of the present invention.

EXAMPLES

In the examples the laser used was a Lissotschenko Mikrooptik (LIMO) laser diode, specifically a 60 watt diode laser LIMO 60-400-F400-DL808. This laser produces light at a wavelength of 808 nm and is coupled to 400 μm fiber optics. The laser requires cooling and this is done using a ThermoTek P308-15009 laser diode cooler. An Amtron CS412 controller is used to control the laser output. The laser and cooler were installed in an (isolated) preparation room and the controller in a separate control room. The preparation room has a door installed with interlocks which will power down the laser if tripped.

For each experiment the laser is connected to an initiating system or component thereof by a fiber optic (200 μm or 400 μm diameter) which is fed into a blast tank through a pipe emanating from the preparation room.

Initiation of PETN

A batch of PETN doped with 2% carbon black was prepared and compacted by hand into an elongate tubular member in the form of a standard SMA 905 bulkhead connector. The exposed end of a fiber optic was inserted into the end of the tubular member to achieve direct contact with the doped PETN. The doped PETN was subjected to a laser power of 38 Watts. There was a significant report and no remaining PETN was observed.

Initiation of Detonating Cord

The configuration illustrated in FIG. 2 was implemented in order to attempt detonation of a 1 m length of detonating cord. A 10 g/m cord was used. Carbon black doped PETN was loaded into a standard SMA 905 bulkhead connector. The fibre optic connector was a standard SMA 905 fitting. On average, 0.3 g of 2% carbon black doped PETN packed to a density of approximately 1.0 g/cm$^3$ was loaded into the bulkhead connector. The bulkhead connector was inserted into a Yorlok compression fitting where the butt weld was reemed and tapped to accept the bulkhead connector.

The initiating explosive was irradiated with 38 W laser energy. This was found to lead to detonation of the detonating cord, no cord remaining after the experiment.

To test if the detonating cord has progressed to full detonation, 3 meters of detonating cord were inserted into laser initiating device. The free end of the detonating cord was tied into a small knot, and inserted into the end of a 2×16' cartridge of Magnafrac packaged emulsion. The system was initiated with 38 W of laser irradiation. The velocity of detonation of the cartridge was measured by the two wire method. The measured value of 4820 m/s. The error in this method is ±200 m/s. For comparison, five cartridges were shot with #8 caps and the VODs recorded. The average VOD was 4850 m/s. From this result the detonating cord had indeed attained full detonation.

Initiation of Pentolite Booster

A design is required that will ensure that the initiation explosive will undergo deflagration to detonation transition (DDT) in order to initiate a booster.

A series of experiments were performed in which various types of confined explosive are confined in an elongate stainless steel tube 3.2 mm inner diameter, 6.4 mm outer diameter, 110 mm length. The tube was sealed at its open end (using cellophane tape) and connected to a fiber optic at the other end. The exposed end of the fiber optic extends into the initiation explosive. The arrangement is shown in FIGS. 3 and 4.

FIG. 3 shows a confined explosive 2 provided in an elongate stainless steel tube 3. The end of the tube 3 is sealed with cellophane tape 12 in order to avoid loss of confined explosive 2. This tape does not influence implementation of the invention in terms of how detonation of the bulk explosive is achieved. A fiber optic 4 is connected to an end of the tube 3 using a suitable connector 5. The exposed end of the fiber optic 4 extends into the confined portion 2. In the embodiment shown in FIG. 3 the confined explosive 2 may be made up of discrete portions of different explosives materials (2*a*, 2*b*). The portion 2*a* adjacent the exposed end of the fiber optic 4 may be rendered more sensitive to heat transfer than the portion remote from the exposed end of the fiber optic 4. Thus, the portion 2*a* may comprise PETN doped with carbon black and the portion 2*b* may simply be PETN.

FIG. 4 illustrates the tube 3 when loaded into a booster 7. To facilitate this the booster 7 may be provided with one or more wells. The tube 3 is sealed in the well using epoxy glue 13. At least a portion of the length of confined explosive 2 is surrounded by the booster 7 when the tube is inserted into the booster well.

The nature of confined explosive used, the laser power, whether detonation occurred and the (approximately) time between when the laser was started and when detonation takes place are shown in the following table. A successful detonation was assessed by comparing the damage done to a witness plate of HDPE (4×2×24 cm) using a booster initiated in accordance with the present invention with the damage done to the same type of witness plate using the same kind of booster (90 g Pentolite) initiated with a #8 cap.

| Experiment number | Explosive composition within the tube | Laser Power (W) | Detonation | Approximate Delay (seconds) |
|---|---|---|---|---|
| 1. | 0.3 g 2% carbon black doped PETN, remaining pure PETN hand compacted, fiber in contact with doped PETN | 38 | Yes | None |
| 2. | 0.3 g 2% carbon black doped PETN, remaining pure PETN hand compacted, fiber in contact with doped PETN | 1.0 | Yes | 0.5 |
| 3. | 0.3 g 20% carbon black doped PETN, remaining pure PETN, fiber in contact with doped PETN | 1.0 | Yes | 0.5 |
| 4. | 0.3 g 50% carbon black doped PETN, remaining pure PETN, fiber in contact with doped PETN | 1.0 | No | — |
| 5. | 0.3 g 50% carbon black doped PETN, remaining pure PETN, fiber in contact with doped PETN | 2.5 | Yes | 1.5 |
| 6. | Carbon black dusted on surface between fiber and PETN, fiber optic in contact with carbon black | 11.0 | Yes | 0.5 |
| 7. | Pure PETN, fiber in contact | 10 | Yes | 8 |
| 8. | 0.3 g 2% carbon black doped PETN, remaining pure PETN, 3 mm gap between fiber and explosive | 1.0 | Yes | None |
| 9. | 0.3 g 2% carbon black doped PETN, remaining pure PETN, 3 mm gap between fiber and explosive | 0.5 | Yes | >0.5 |
| 10. | Loose 2% carbon black doped PETN | 38 | Yes | 13 |
| 11. | Cast pentolite doped with 2% carbon black | 30 | Yes | 15 ms |
| 12. | Cast pentolite doped with 2% carbon black | 5 | Yes | 15 ms |

There are several features to note. Firstly, the carbon black appears to be an effective agent to efficiently couple the radiant energy to the explosive. Without the carbon black, it requires almost three orders of magnitude more energy to initiate than the PETN doped with 2% carbon black. Energy is simply the power multiplied by time, and at a constant power as supplied by the laser, the laser is required to run longer to reach a critical point. For further comparison see experiment numbers 3 and 10.

Secondly, there appears to be a optimum concentration of carbon black in the PETN. Experiment numbers 2 and 3 are identical whereas increasing the amount of carbon black to 50% has a detrimental effect. Apparently, there is a point where the PETN is diluted enough to require substantially more energy to initiate. This could be either a heat transfer effect or an inability of the PETN to properly propagate under this condition.

Thirdly, the gap between the fiber optic and the surface of the explosive has a substantial effect on the delay time as can be seen in experiments 8 and 9. The air gap is most probably acting as an insulating layer.

Fourthly, cast pentolite doped with carbon black was easily detonated at relatively high and low laser power.

Finally, and most importantly, this design allows boosters to be detonated at relatively low laser powers. As a consequence, design of a portable initiation system is quite feasible.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. A detonator free blasting system, which comprises:

a bulk explosive;

a confined explosive;

a fiber optic adapted to deliver laser light to the confined explosive, wherein the confined explosive is provided relative to the bulk explosive such that detonation of the confined explosive causes initiation of the bulk explosive.

2. A system according to claim 1, wherein a portion of the confined explosive and a portion of the bulk explosive are in direct contact.

3. A system according to claim 1, wherein the confined explosive and bulk explosive are separated by a membrane.

4. A system according to claim 1, wherein the confined explosive is a secondary explosive material.

5. A system according to claim 4, wherein the confined explosive is PETN or pentolite.

6. A system according to claim 1, wherein the bulk explosive material is a secondary explosive material.

7. A system according to claim 1, wherein the confined explosive is confined in an elongate tubular member.

8. A system according to claim 7, wherein the internal diameter of the tubular member is greater than the critical diameter for the explosive being confined.

9. A system according to claim 1, wherein one end of the fiber optic is in contact with, or embedded in, the confined explosive.

10. A system according to claim 1, wherein an exposed end of the fiber optic is provided adjacent to but not in contact with the confined explosive.

11. A system according to claim 1, wherein the confined explosive includes a non-explosive heat transfer medium in order to enhance coupling of the laser light energy to the confined explosive.

12. A system according to claim 11, wherein the heat transfer medium is selected from carbon black, carbon nanotubes, nanodiamonds and laser dyes.

13. A system according to claim 1, wherein the confined explosive is provided in an elongate tubular member that is embedded in a booster.

14. A system according to claim 1, wherein a pentolite booster is cast around and with a suitable tubular member that confines the confined explosive.

15. A system according to claim 1, wherein the bulk explosive takes the form of a length of detonating cord with an end of the detonating cord being provided in direct contact with at least a portion of the confined explosive.

16. A system according to claim 1, wherein the confined explosive and bulk explosive are emulsion explosive compositions.

17. A method of initiating a bulk explosive without using a detonator, which method comprises:

detonating a confined explosive by irradiation with a laser, and providing the confined explosive relative to the bulk explosive, such that detonation of the confined explosive causes initiation of the bulk explosive.

* * * * *